US005268546A

United States Patent [19]

Berg

[11] Patent Number: 5,268,546

[45] Date of Patent: Dec. 7, 1993

[54] MICROWAVE OVEN WITH BROWNING MEANS, A BROWNING PLATE FOR USE IN A MICROWAVE OVEN

[75] Inventor: Lars-Erik Berg, Kimstad, Sweden

[73] Assignee: Whirlpool International B.V., Veldhoven, Netherlands

[21] Appl. No.: 755,383

[22] Filed: Sep. 5, 1991

[30] Foreign Application Priority Data

Sep. 28, 1990 [SE] Sweden ..... 9003104

[51] Int. Cl.[5] ..... H05B 6/64

[52] U.S. Cl. ..... 219/10.55 R; 219/10.55 E; 219/10.55 F; 219/10.55 A; 99/DIG. 14; 426/234; 426/243; 426/107

[58] Field of Search ..... 219/10.55 R, 10.55 E, 219/10.55 F, 10.55 M, 10.57, 10.67, 10.55 A, 0.55 B; 99/DIG. 14; 426/243, 438, 234, 107

[56] References Cited

U.S. PATENT DOCUMENTS

| | | | |
|---|---|---|---|
| 2,138,162 | 11/1938 | Hansell | 219/10.55 E |
| 2,830,162 | 4/1958 | Copson et al. | 219/10.55 E |
| 3,302,632 | 2/1967 | Fichtner | 219/10.55 E |
| 4,329,557 | 5/1982 | Staats | 219/10.55 F |
| 4,369,346 | 1/1983 | Hart et al. | 219/10.55 E |
| 4,450,334 | 5/1984 | Bowen et al. | 219/10.55 E |
| 4,486,640 | 12/1984 | Bowen et al. | 219/10.55 E |
| 4,558,198 | 12/1985 | Levendusky et al. | 219/10.55 E |
| 4,566,804 | 1/1986 | Collins et al. | 219/10.57 |
| 4,594,492 | 6/1986 | Maroszek | 219/10.55 E |
| 4,676,857 | 6/1987 | Scharr et al. | 156/233 |
| 4,818,831 | 4/1989 | Seaborne | 219/10.55 E |
| 5,015,813 | 5/1991 | Yamada et al. | 219/10.55 F |
| 5,019,680 | 5/1991 | Morino et al. | 219/10.55 E |
| 5,079,398 | 1/1992 | Kuziemka et al. | 219/10.55 E |

*Primary Examiner*—Bruce A. Reynolds
*Assistant Examiner*—Tu Hoang
*Attorney, Agent, or Firm*—Robert O. Rice; Stephen D. Krefman; Thomas E. Turcotte

[57] ABSTRACT

A microwave oven having browning means which includes a metal browning plate (10), the underside of which is provided with a layer (11) of a ferrite material. Via an input opening (6) for supplying microwaves to the oven cavity, polarized microwaves are propagated into a space provided under the browning plate. The browning plate is preferably of a circular shape and fitted to be carried by a rotating bottom plate (8) in the microwave oven.

10 Claims, 1 Drawing Sheet

MICROWAVE OVEN WITH BROWNING MEANS, A BROWNING PLATE FOR USE IN A MICROWAVE OVEN

BACKGROUND OF THE INVENTION

This invention is directed to a microwave oven comprising means for browning a piece of food, an oven cavity, a microwave source and a feeding system for supplying polarized microwaves to the cavity. The invention is also directed to a rotating browning plate for use in a microwave oven having a rotating bottom plate in the load zone of the oven cavity and, adjoining the cavity bottom, an input opening in a sidewall of the cavity for supplying polarized microwaves with an E-field which is substantially vertical.

1. Field of the Invention

A general problem when preparing food in microwave ovens is the difficulty in obtaining browning or a browned surface on the food. Many proposals to the solution thereof have been developed among others in the shape of accessories to the microwave oven, specifically shaped vessels for use in the oven, as well as specifically shaped packings for prefabricated dishes on the one hand. A specific problem of these accessories, vessels and packings is the influence thereof on the propagation of microwaves in the cavity and a consequent risk of an inferior cooking result in comparison with the situation when the cooking takes place without such facilities. Changes of the microwave propagation may also bring with it a decreased microwave efficiency in the oven. In consequence thereof problems will arise in obtaining a rapid and even heating, which may bring with it among other things an overheating of edge areas.

2. Description of the Related Art

From the U.S. Pat. No. 2,138,162 it is previously known to convert microwave energy to heat energy by using a ferrite material which may be arranged on the underside of a vessel. Measurements in order to speed up and improve the efficiency of the energy absorption are not disclosed in the publication. The SE patent specification no 343742 is also based on the use a ferrite material in a so called absorbator, which may comprises a free plate alternatively being arranged at the bottom of the vessel. In the microwave oven disclosed therein the absorbator is supplied with microwave energy via a so called microwave applicator, being specifically adapted for the purpose. The disclosed construction of the applicator, as well as the microwave oven comprising the same, however, have a technical structure which is complicated and cost demanding. EP-A1-0317203 describes a plate of a microwave energy absorbing material, in which regions are obtained having different "loss characteristics", partly absorbing microwave energy, partly providing a coupling to the microwaves and initiating thereby higher modes of oscillation propagation in the food piece/load which is placed on the plate. Measurements in order to speed up and improve the efficiency of the heating progress have not been disclosed. One further example of the prior art is found in U.S. Pat. No. 4,369,346 which discloses a ceramic plate specifically shaped for baking purposes, for example baking of pizzas. In the ceramic material on the under side of the plate a pattern of microwave absorbing areas have been provided by means of ion implantation into the ceramic material.

Examples of the specifically designed packings for use in microwave ovens are disclosed in U.S. Pat. Nos. 3,302,632, 4,594,492, and 4,676,857. In these packings parts of the packings have been fitted by the use of metal foil etc in order to obtain the desirable heating, browning and crisping effects. Such packings, however, only to a small extent are related to the invention.

All of the prior art solutions, except SE 343742, are lack of adaption between the proposed facilities and the propagation of microwaves in the oven in which the same are intended for use.

SUMMARY OF THE INVENTION

One object of the invention is to provide a microwave oven making possible browning and crisping of a food piece without the drawbacks of the prior art, maintaining a desirable microwave propagation in the oven cavity and a good microwave efficiency.

The object of the invention is obtained by a microwave oven of the type mentioned in the introduction, which according to the invention is characterized in that the browning means comprises a metal plate of good thermal conductivity, one side of which is intended to be in contact with the piece of food and the other side of which is provided with a layer of magnetically loss generating material, e.g. comprising a ferrite material, and in that the input system comprises a waveguide device having at least one input opening which is arranged to establish a field concentration of polarized microwaves along the material layer the magnetic field vector of which is directed substantially along the material layer in order to generate magnetic losses in the material layer and thereby heat the metal plate.

The field concentration of polarized microwaves along the material layer makes possible the use of a metal plate, having advantages from the point of heat equalization, and nevertheless an effective absorption of microwave energy in the loss generating material layer and thereby a faster heating of the metal plate.

One preferred embodiment of the microwave oven according to the invention, in which the input opening is provided adjacent to the cavity bottom in a sidewall of the cavity, while the metal plate is shaped as a browning plate to be positioned horizontally in the load zone of the cavity, on the upper side of which the food piece is positioned during food preparation, is characterized by having spacer means for carrying the browning plate in the load zone at a distance from the cavity bottom, in which the input opening is arranged to supply microwaves with a substantially vertical E-field and propagating in the space provided by the spacer means between the magnetic loss generating material layer of the browning plate and the cavity bottom.

The microwave propagation under the browning plate makes possible a stable field concentration and a good heat equalization in the metal of the browning plate. Heating of a metallic browning plate in a traditional microwave oven by incident microwaves on the plate from the upper part of the cavity is practically impossible because the metal plate reflects the microwaves and the major part of the microwave energy is instead absorbed by the food on the browning plate.

One further preferred embodiment of the microwave oven according to the invention comprises a further input opening in the sidewall at the cavity roof. In this embodiment the input openings adjoin a vertical centre line of the sidewall and is characterized in that the waveguide device is resonant for the microwaves from the microwave source and shaped to supply the polarized microwaves as coherent and locked in phase opposition at the respective input openings, whereby the influence of the browning plate and the load on the microwave supply via the input openings is substantially eliminated and the microwave propagation in the space under the browning plate is safeguarded.

One further preferred embodiment of the microwave oven according to the invention is characterized in that the browning plate is circular, that the spacer means also comprises a substantially circular, rotating bottom plate of microwave penetratable material, on which the browning plate is arranged and follows the rotation of the bottom plate during food preparation, and in that the underside of the browning plate has a shape which is fitted to the upper side of the bottom plate in order to obtain a stable contact between the same. By the rotation of the browning plate is obtained a further improved heat equalization in the browning plate, making possible a corresponding more even browning of the adjoining side of the food piece.

The microwave oven according to the invention may further be characterized in that the browning means comprises an electric heat element provided at the roof of the cavity in order to provide, in cooperation with the browning plate, a simultaneous browning of the upper side and the underside of the food piece. Because of the effective microwave absorption and thereby the rapid heating of the browning plate according to the invention, a mutual adaption of the browning effect of the browning plate respectively the browning element is simplified, and thereby a desireable browning of both sides may be obtained at the same time without requiring a turn over of the food piece.

A further object of the invention is to provide a rapidly heatable browning plate having a good heat equalization, and of a design which is adequate for use as an easily applicable accessory of a microwave oven with a rotating bottom plate and an input opening for microwaves adjoining a cavity bottom.

The object of the invention is obtained by a browning plate of the type mentioned in the introduction, which is characterized in that the browning plate comprises a substantially circular metal plate of good heat conductivity, the underside of which is provided with a layer comprising a ferrite material and covering substantially the complete underside of the plate, the ferrite material having a selected Curie-point lower than the desirable maximum temperature of the metal plate during food preparation, and that the underside of the metal plate is designed to be stably and detachably carried by the rotating bottom plate alternatively the rotation mechanism of the bottom plate, the browning plate being thereby heated substantially by the absorption in the ferrite layer of H-field energy from microwaves propagating in the space between the cavity bottom and the browning plate.

The metal of good heat conductivity in combination with the fact that the browning plate according to the invention has a design which is adapted to the rotating bottom plate or the rotation mechanism of the same, makes it possible to obtain the desirable good heat equalization in the plate. By allowing the browning plate to be carried by the rotating bottom plate or the rotation mechanism of the same, it is possible to obtain, in simple manner, a wave propagation space under the browning plate and thereby rapid heating of the same by the absorption of microwave energy in the ferrite layer. By these measures the need is eliminated of a separate preheating of the browning plate before the food is placed on the same. The choice of the Curie-point of the ferrite material has the consequence that the energy absorption will substantially stop in areas of the ferrite layer that reach the Curie-point, and as a result the conduction of heat to corresponding parts of the metal plate is substantially stopped, which contributes to the heat equalization in the metal plate and eliminates the risk of overheating of its empty parts, e.g. the edge areas thereof.

BRIEF DESCRIPTION OF THE DRAWINGS

The invention and its advantages will be described in greater detail in the following description taken in connection with the preferred embodiment which is shown in the drawings, in which.

DETAILED DESCRIPTION OF THE PREFERRED EMBODIMENTS

Figure 1:
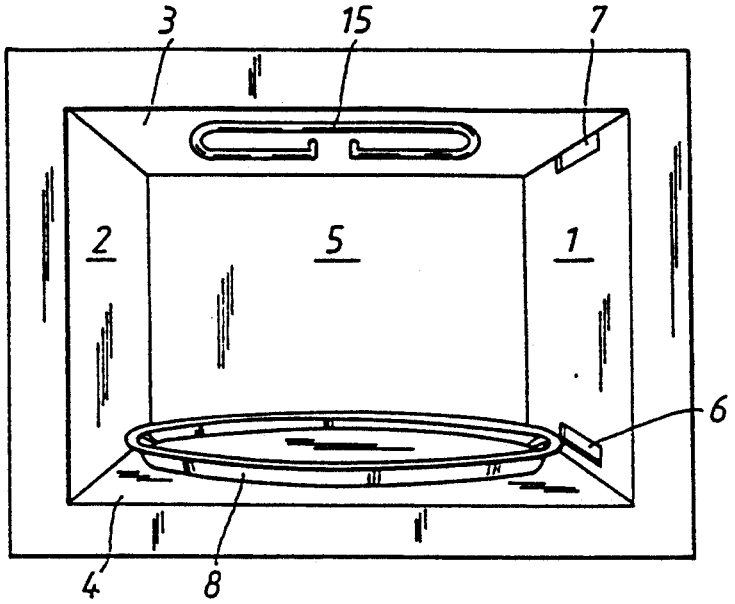
FIG. 1 schematically shows a frontal view of the oven cavity in a microwave oven according to the invention with the browning plate eliminated.

FIG. 1 shows schematically the oven cavity in a microwave oven according to the invention, in which the door for closing the cavity has been omitted. The cavity has the shape of a rectangular parallelepiped or a cube with sidewalls 1 and 2, a roof 3 and a bottom 4, and a backwall 5. In the sidewall 1 are provided two input openings 6 and 7 for the supply of microwaves into the cavity from a microwave source (not shown) via a waveguide device 16 (see FIG. 2). The input openings and the waveguide device are arranged to supply microwave which are coherent and locked in phase opposition and have a substantially vertical E-field in the cavity. For a detailed description of the microwave input system phase refer to the Swedish patent application no 9003012-3 (PHZ 90007). FIG. 1 shows also schematically an electric browning element 15 at the cavity roof 3 for browning the upper side of a food piece.

As is clear from FIG. 1 the input opening 6 is positioned at some distance above the cavity bottom 4, while the input opening 7 is positioned adjacent to the roof 3. In the cavity is provided a circular bottom plate 8 of a microwave transparent material, e.g. glass or ceramics. The bottom plate may in turn be carried by a rotation mechanism 9, as is desclosed in more detail in FIG. 2.

Figure 2:
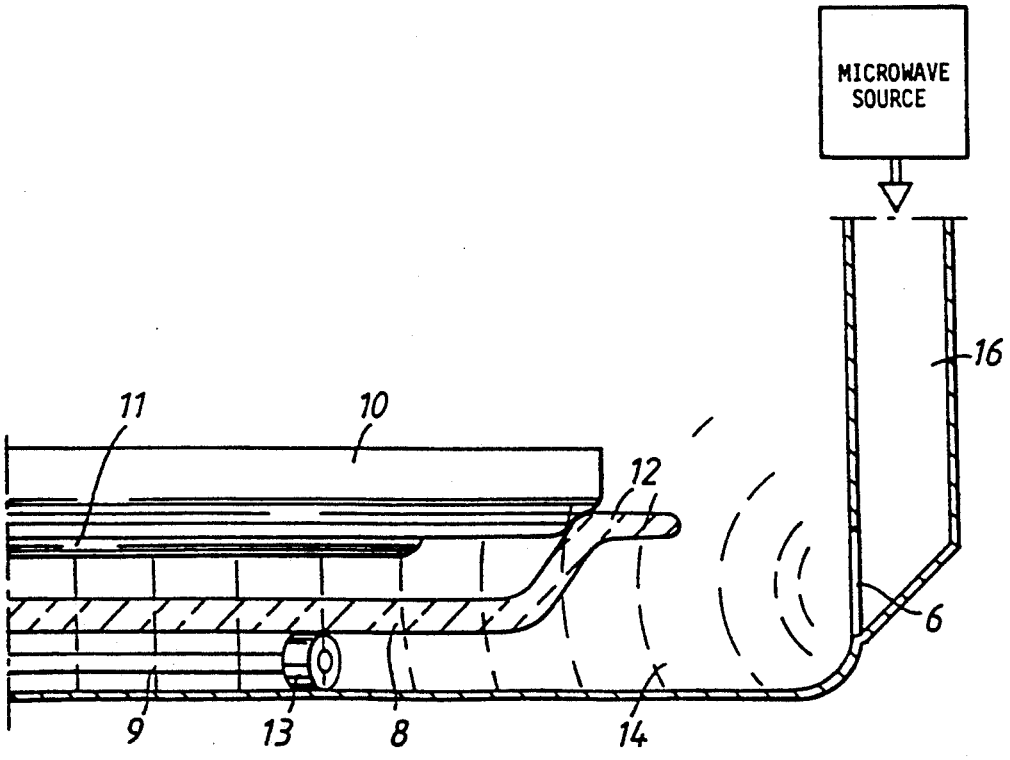
FIG. 2 shows a partly sectioned blow up of a part of FIG. 1 with the browning plate according to the invention arranged in its operating position.

FIG. 2 shows a blow up of a part of FIG. 1 with the browning plate 10 placed on the bottom plate 8. According to FIG. 2 the browning plate 10 has an underside of a shape which is adapted to the upper side of the bottom plate 8 in order to obtain a stable contact between the same. Alternatively the bottom plate 8 may be removed and the browing plate 10 placed directly against the rotation mechanism.

The underside of the browning plate 10 is provided with a layer 11 comprising a ferrite material, the layer covering substantially the complete underside of the browning plate. The browning plate itself is manufactured from aluminium or a similar metal having a good heat conductivity and fitted for carrying a piece of food lying directly thereon, for example a pie. In a different embodiment the contact surface of the browning plate may consist of a thin layer of stainless steel the underside of which is covered with a thicker aluminium layer, in turn carrying the ferrite layer.

The outer edge of the underside of the browning plate 10 rests against a circumferential edge 12 of the bottom plate 8. Due to the fact that the browning plate in this manner rests freely against the bottom plate the same is easily inserted into the microwave oven in cases where the food preparation comprises browning, and is simply removed from the oven when this is not the case.

In FIG. 2 a rotation mechanism for the bottom plate has been partly shown by a leg 9 the outer end of which is provided with a wheel 13. A commonly used rotation mechanism comprises three legs of this kind arranged on a centre part at mutual angles of 120°. The centre part is rotated by means of an electric motor provided under the cavity bottom and having a through shaft connected to the central part. By the rotation the wheels 13 are brought to roll on the cavity bottom, thereby providing rotation of the bottom plate 8 resting against the wheels. The browning plate 10 rests on the bottom plate and follows the rotation thereof.

The rotation mechanism and the bottom plate together form a spacer means carrying the browning plate 10 at a distance from the cavity bottom. Thereby is obtained a microwave propagation space between the ferrite layer of the browning plate and the bottom plate. The input opening 6 is provided at the level of this space, which means that a defined part of the microwaves from the input opening will propagate through said space.

The microwave propagation in the space between the browning plate and the cavity bottom has been shown by dashed circular arcs 14 in FIG. 2. The input opening 6 provides microwaves having a substantially vertical E-field and a substantially horizontal H-field. By the direct input of microwaves into the space under the browning plate and the fact that the H-field substantially coincides with the plane of the ferrite material layer, a very good energy absorption is obtained in the ferrite material and consequently a good transfer of heat to the aluminium plate and a rapid heating of same.

Dependent on the intended use of the browning plate a maximum temperature of the same is decided corresponding to the desirable browning temperature. Thereafter a ferrite material having a Curie-point below the maximum temperature is chosen. By this choice the microwave absorption in the ferrite layer will substantially be interrupted in areas in which the Curie-point is reached, which will first take place in areas in which the heat transfer from the metal plate to the piece of food is small. When the complete ferrite layer has reached the Curie-point the energy absorption in the layer will substantially be stopped, and thereby the microwaves in the space under the browning plate will be reflected against the metal plate of the browning plate, and thereafter the propagation will continue out and into the cavity past the edges of the browning plate. In this condition, when the browning plate has reached its maximum temperature and thereby generates the desirable high underheat to the piece of food on the browning plate, microwave energy will be absorbed only by the piece of food itself. When thereafter the heat dissipation from the browning plate to the piece of food decreases the temperature thereof in some part, a temperature decrease will appear also in the corresponding part of the ferrite layer, which will then again start absorbing microwave energy and transferring heat to the browning plate. As a result the complete surface of the browning plate will maintain a substantially even temperature equal to the desirable browning temperature, and simultaneously a good microwave efficiency is obtained because the energy which is not absorbed by the browning plate will mainly be absorbed by the load. The substantially constant temperature of the browning plate provides for a well defined browning process, which in turn simplifies an adaption of the heat effect and the design of the browning element 15 of the cavity roof 3, such that a corresponding browning of the upper side of the piece of food may be obtained within the same lapse of time.

In conclusion the following features mainly contribute to a good browning result using the browning plate according to the invention, namely: direct input of microwaves into a wave guide space under the browning plate, giving an efficient and rapid heating of the plate; a plate of aluminium or other metal of good heat conductivity, providing heat equalization between warmer and colder areas of the plate; a rotating browning plate, contributing to an improved heat equalization in the plate; a Curie-point of the ferrite material layer of the browning plate which is selected so that the desirable browning temperature occurs in the area of contact with the piece of food.

In the description and the patent claims the denomination "ferrite material" has been used for the microwave energy absorbing layer 11. This is understood to mean generally a material having the ability to generate magnetic loss energy in a microwave field in the way which is described in the U.S. Pat. No. 2,830,162.

I claim:

1. A microwave oven comprising: a browning plate for browning a piece of food, an oven cavity, including a load zone above a bottom wall and below a roof, a microwave source for generating microwaves and an input system for feeding polarized microwaves into the cavity, said browning plate comprising a heat conducting plate having a first side contacting with the piece of food and a second side of which is provided with a layer of magnetic loss generating material, and spacer means for carrying the browning plate in the load zone at a distance from the cavity bottom wall, said input system comprising a wave guide device having at least one first input opening arranged to establish a field concentration of polarized microwaves along said layer of magnetic loss generating material wherein a magnetic field vector of said field concentration is directed with a substantially vertical electric field along said layer of magnetic loss generating material in order to generate magnetic losses in the layer of magnetic loss generating material and thereby heat said heat conducting plate.

2. A microwave oven as claimed in claim 1 comprising a further input opening in a sidewall of said oven cavity at the cavity roof, wherein said at least one input opening and further input opening coincide with a vertical center line of said sidewall, characterized in that said wave guide device is resonant for the microwaves from the microwave source and shaped for supplying said polarized microwaves as being coherent and locked in phase opposition at said at least one input opening and said further input opening, whereby the microwaves supply via said openings is substantially stable for varying load sizes and said field concentration of polarized microwaves in a space under the browning plate is also stable.

3. A microwave oven as claimed in claim 1, characterized in that said browning plate is circular, that said spacer means also comprises a substantially circular rotating bottom plate of a material which is microwave penetratable, on which the browning plate is positioned for rotation with the rotating bottom plate during food preparation, and that the second side of the browning plate is adapted to an upper side of the rotating bottom plate for a stable contact therebetween.

4. A microwave oven as claimed in claim 1, wherein an electric heat element is located at the roof of the cavity in order to provide, in cooperation with the browning plate, simultaneous browning of an upper side and an underside of the food.

5. A microwave oven as claimed in claim 2, characterized in that said browning plate is circular, that said spacer means also comprises a substantially circular, rotating bottom plate of a material which is microwave penetratable and on which the browning plate is positioned and rotates with the bottom plate during food preparation, and that the second side of the browning plate is adapted to an upper side of the bottom plate for a stable contact therebetween.

6. A microwave oven as claimed in claim 1 wherein said magnetic loss generating material comprises a ferrite material.

7. A microwave oven as claimed in claim 6 wherein said ferrite material has a curie-point lower than a maximum preselected operating temperature of the heat conducting plate during a heating operation of the food.

8. A microwave oven as claimed in claim 6 wherein an electric heat element is located at the roof of the cavity in order to provide, in cooperation with the browning plate, simultaneous browning of an upper side and underside of the food.

9. A rotating browning plate for use in a microwave oven having a rotating bottom plate in a load zone of an oven cavity spaced from a cavity bottom and, adjoining the cavity bottom, an input opening in a sidewall of the oven cavity for supplying polarized microwaves with a substantially vertical electric field, characterized in that a browning plate formed by a substantially circular metal plate of high heat conductivity, an underside of the metal plate is provided with a layer comprising a ferrite material and covering substantially the underside of the metal plate, said ferrite material having a selected Curie-point lower than a preselected maximum temperature of the metal plate during food preparation, and that the underside of the metal plate is arranged to be stably and detachably carried by said rotating bottom plate, wherein the browning plate is heated substantially by absorption in the layer of ferrite material of inductive field energy from microwaves propagating with a vertical electric field in a space between the cavity bottom and the browning plate.

10. A rotating browning plate as claimed in claim 5, wherein said ferrite material is embedded in a temperature resistant silicon rubber.

* * * * *